US010480270B2

(12) United States Patent
Massey

(10) Patent No.: US 10,480,270 B2
(45) Date of Patent: Nov. 19, 2019

(54) DOWNHOLE IMPACT APPARATUS

(71) Applicant: Impact Selector International, LLC, Houma, LA (US)

(72) Inventor: James P. Massey, Breckenridge, CO (US)

(73) Assignee: IMPACT SELECTOR INTERNATIONAL, LLC, Houma, LA (US)

( * ) Notice: Subject to any disclaimer, the term of this patent is extended or adjusted under 35 U.S.C. 154(b) by 158 days.

(21) Appl. No.: 15/803,799

(22) Filed: Nov. 5, 2017

(65) Prior Publication Data

US 2018/0334874 A1 Nov. 22, 2018

Related U.S. Application Data

(60) Provisional application No. 62/508,905, filed on May 19, 2017.

(51) Int. Cl.
*E21B 31/113* (2006.01)

(52) U.S. Cl.
CPC ..... *E21B 31/1135* (2013.01)

(58) Field of Classification Search
CPC ... E21B 31/107; E21B 31/113; E21B 31/1135
See application file for complete search history.

(56) References Cited

U.S. PATENT DOCUMENTS 2,733,045 A 1/1956 Burns, Jr.
2,837,315 A 6/1958 Burns, Jr. et al.
5,174,393 A * 12/1992 Roberts ..... E21B 31/113 166/178
5,918,689 A * 7/1999 Roberts ..... E21B 31/113 166/178
6,182,775 B1 2/2001 Hipp
(Continued)

FOREIGN PATENT DOCUMENTS

AU 2015249878 A1 6/2016
WO 2009047708 A2 4/2009
WO 2017087504 A1 5/2017

OTHER PUBLICATIONS

PCT/US2016/062249 filed Nov. 16, 2016, Written Opinion of the International Searching Authority, dated Apr. 3, 2017, 10 pages.
(Continued)

*Primary Examiner* — Kenneth L Thompson
(74) *Attorney, Agent, or Firm* — Boisbrun Hofman, PLLC

(57) ABSTRACT

An impact apparatus operable to be coupled along and impart an impact to a downhole tool string. The impact apparatus includes a housing, a first and second chambers within the housing, and a piston shaft assembly movable with respect to the housing. The piston shaft assembly includes a first piston slidably disposed within and dividing the first chamber into a first chamber portion and a second chamber portion, a first shaft connected with the first piston and axially movable into and out of the housing, a second piston slidably disposed within the second chamber, and a second shaft connecting the first and second pistons. The first chamber portion is open to a space external to the housing. The second chamber contains a fluid operable to maintain the piston shaft assembly and the housing in a predetermined relative position.

16 Claims, 4 Drawing Sheets

(56) References Cited

U.S. PATENT DOCUMENTS

| | | | | |
|---|---|---|---|---|
| 8,365,818 | B2 * | 2/2013 | Schultz | E21B 31/1135 166/178 |
| 8,499,836 | B2 * | 8/2013 | Moriarty | E21B 31/107 166/178 |
| 2002/0053434 | A1 | 5/2002 | Chen et al. | |
| 2009/0095490 | A1 | 4/2009 | Moriarity et al. | |
| 2012/0227970 | A1 | 9/2012 | Schultz et al. | |
| 2018/0363402 | A1 * | 12/2018 | Hradecky | E21B 31/1135 |

OTHER PUBLICATIONS

PCT/IB2017/056911, filed Feb. 23, 2018, International Search Report dated Nov. 5, 2017, 5 pages.

* cited by examiner

DOWNHOLE IMPACT APPARATUS

CROSS-REFERENCE TO RELATED APPLICATIONS

This application claims priority to and the benefit of U.S. Provisional Patent Application No. 62/508,905, titled "DOWNHOLE IMPACT APPARATUS," May 19, 2017, the entire disclosures of which is hereby incorporated herein by reference.

BACKGROUND OF THE DISCLOSURE

Drilling operations have become increasingly expensive as the need to drill deeper, in harsher environments, and through more difficult materials has become a reality. In addition, testing and evaluation of completed and partially finished wellbores has become commonplace, such as to increase well production and return on investment. Consequently, in working with deeper and more complex wellbores, it becomes more likely that tools, tool strings, and/or other downhole equipment may become stuck within the wellbore.

A downhole impact or jarring tool may be utilized to dislodge stuck downhole equipment. The impact or jarring tool (hereafter collectively referred to as simply "impact tool") may be included as part of a tool string and deployed downhole along with the downhole equipment, or the impact tool may be deployed downhole after equipment already downhole becomes stuck. Tension may be applied from a wellsite surface to the deployed tool string via a conveyance means to store elastic energy in the tool string and the conveyance means. After sufficient tension is applied to the impact tool, the impact tool may be triggered to release the elastic energy in the impact tool and the conveyance means, thereby delivering an impact intended to dislodge the stuck downhole tool or to break a shear pin to disconnect a portion of the tool string from the stuck downhole tool.

However, in some downhole applications, such as in deviated wellbores or when multiple bends are present along the wellbore, friction between a sidewall of the wellbore and the conveyance means may reduce or prevent adequate tension from being applied to the impact tool. In such situations, the impact tool may be unable to produce an impact that is sufficient to dislodge the stuck downhole tool or break the shear pin.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
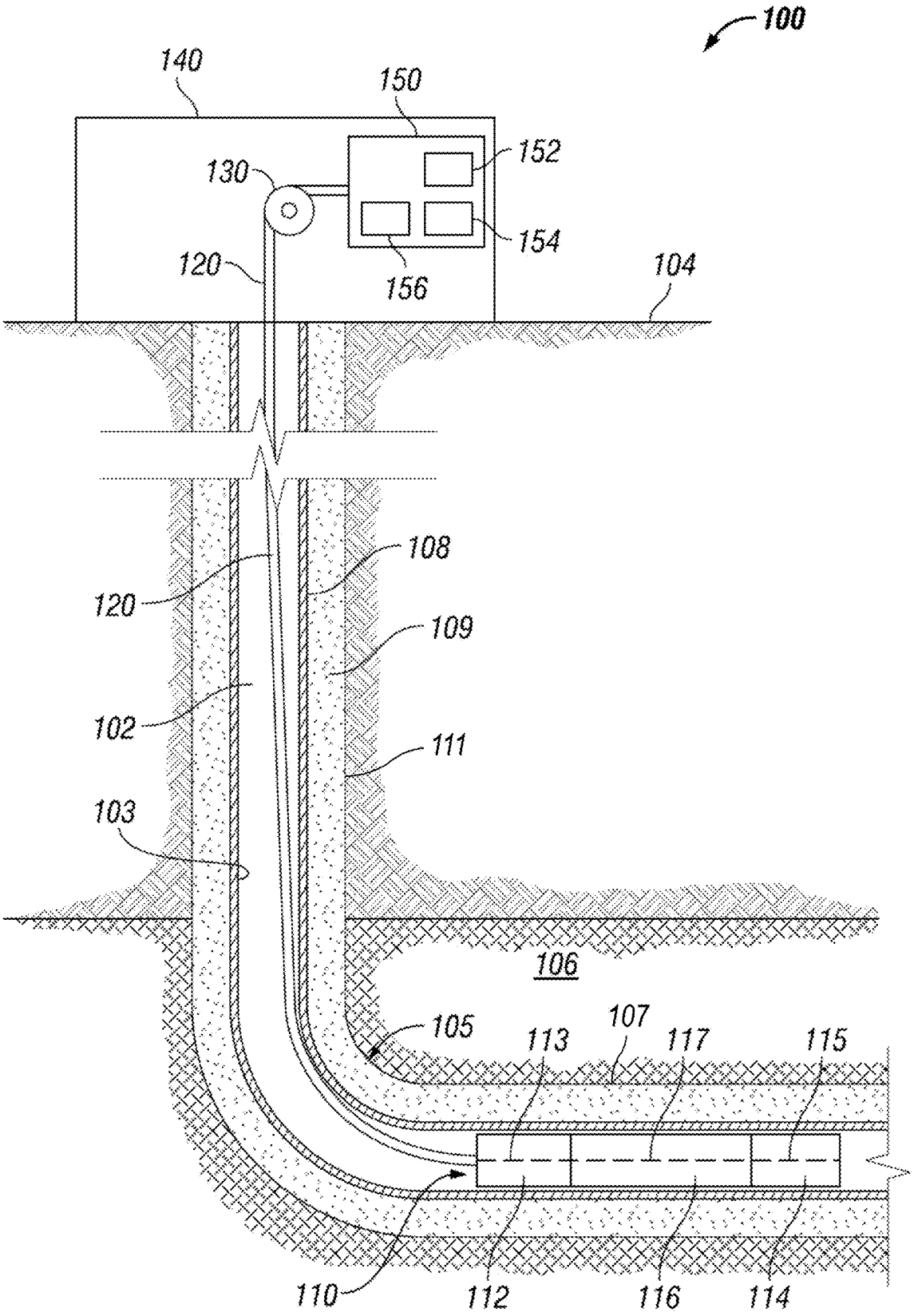
FIG. 1 is a schematic view of at least a portion of an example implementation of apparatus according to one or more aspects of the present disclosure.

It is to be understood that the following disclosure provides many different implementations, or examples, for implementing different features of various implementations. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various implementations described below. Moreover, in the description below, the formation of a first feature over or on a second feature may include implementations in which the first and second features are formed in direct contact, and may also include implementations in which one or more additional features may be formed interposing the first and second features, such that the first and second features may not be in direct contact.

Existing impact tools included in downhole tool strings are operable to impart an impact (i.e., a force) to the tool string when the tool string is stuck in a wellbore. Energy for performing the impact may be stored (e.g., during jarring operations) within the impact tool, and perhaps also within the conveyance means used to convey the tool string into the wellbore. When the tool string gets stuck in the wellbore, the conveyance means is pulled from the wellsite surface in an uphole direction to build up tension and, thus, store elastic energy in the impact tool and the stretched conveyance means. The stored energy is released by triggering the impact tool at a predetermined time or situation.

Downhole impact tools within the scope of the present disclosure, however, are operable to store energy in the form of a pressure differential between ambient wellbore pressure external to the downhole impact tool and an internal pressure of the downhole impact tool. The pressure differential may be released or otherwise utilized to cause an impact between portions of the impact tool, such as to free a stuck portion of the tool string, and/or to break a shear pin to release a portion of the tool string for conveyance to the wellsite surface.

The downhole impact tool may comprise a housing, a chamber within the housing that is open to a space external to the housing, and a movable piston and shaft assembly fluidly isolating a portion of the chamber from the space external to the housing. The chamber may contain air or another gas at a predetermined pressure, such as atmospheric pressure (i.e., surface pressure) or another pressure. Thus, one side of a piston of the piston and shaft assembly may be exposed to the isolated portion of the chamber and, thus, the chamber pressure, while an opposing side of the piston may be exposed to a portion of the chamber exposed to the space external to the impact tool and, thus, hydrostatic wellbore pressure.

The downhole impact tool may be coupled along the tool string and conveyed downhole with the tool string. During downhole conveyance, the piston and shaft assembly may be locked or otherwise maintained in a predetermined position with respect to the housing or body of the impact tool, thus preventing relative movement between the piston and shaft assembly and the housing. Accordingly, the pressure within the isolated portion of the chamber may be maintained substantially lower than the pressure within the portion of the chamber open to the space external to the housing. As the downhole impact tool is conveyed deeper within the wellbore and the pressure within the wellbore increases, an increasing pressure differential is formed across the piston, storing an increasing amount of energy. The energy stored by or within the isolated portion of the chamber and the piston may be proportional or otherwise related to the hydrostatic wellbore pressure around the impact tool.

Releasing or freeing the piston and shaft assembly from or with respect to the housing may permit the pressure differential to cause relative movement between the piston and shaft assembly and the housing, accelerating the portion of the tool string that is not stuck. The relative movement between the piston and shaft assembly and the housing may terminate when the piston and shaft assembly, the housing, and/or other portions of the impact tool contact or impact each other to suddenly stop or decelerate the moving portion of the impact tool and the tool string, causing an impact force to be imparted through the impact tool to the stuck portion of the tool string. The impact may be utilized to free a stuck portion of a tool string, or to break a shear pin to release a portion of the tool string for conveyance to the wellsite surface.

FIG. 1 is a schematic view of at least a portion of a wellsite system 100 showing an example environment comprising or utilized in conjunction with a downhole tool string 110 comprising an impact tool 116 according to one or more aspects of the present disclosure. The tool string 110 may be suspended within a wellbore 102 that extends from a wellsite surface 104 into one or more subterranean formations 106. The wellbore 102 may be a cased-hole implementation comprising a casing 108 secured by cement 109. However, one or more aspects of the present disclosure are also applicable to and/or readily adaptable for open-hole implementations lacking the casing 108 and cement 109. The tool string 110 may be suspended within the wellbore 102 via a conveyance means 120 operably coupled with a tensioning device 130 and/or other surface equipment 140 disposed at the wellsite surface 104, including a power and control system 150.

The tensioning device 130 may apply an adjustable tensile force to the tool string 110 via the conveyance means 120 to convey the tool string 110 along the wellbore 102. The tensioning device 130 may be, comprise, or form at least a portion of a crane, a winch, a draw-works, a top drive, and/or another lifting device coupled to the tool string 110 by the conveyance means 120. The conveyance means 120 may be or comprise a wireline, a slickline, an e-line, coiled tubing, drill pipe, production tubing, and/or other conveyance means, and may comprise and/or be operable in conjunction with means for communication between the tool string 110, the tensioning device 130, and/or one or more other portions of the surface equipment 140, including the power and control system 150. The conveyance means 120 may comprise a plurality of conductors, including electrical and/or optical conductors, extending between the tool string 110 and the surface equipment 140. The power and control system 150 may include a source of electrical power 152, a memory device 154, and a controller 156 operable to receive and process electrical and/or optical signals from the tool string 110 and/or commands from a surface operator. The controller 156 may also be operable to transmit signals downhole to the tool string 110, such as via the conveyance means 120.

The tool string 110 is shown positioned in a non-vertical portion 107 of the wellbore 102 resulting in the conveyance means 120 coming into contact with a sidewall 103 of the wellbore 102 along a bend or deviation 105 in the wellbore 102. The contact causes friction between the conveyance means 120 and the sidewall 103, such as may impede or reduce the tension being applied to the tool string 110 and the impact tool 116 by the tensioning device 130. However, the tool string 110 and the impact tool 116 may also be utilized within a substantially vertical well or well portion 111 of the wellbore 102.

The tool string 110 may comprise an uphole portion 112, a downhole portion 114, and the impact tool 116 coupled between the uphole portion 112 and the downhole portion 114. The uphole portion 112 of the tool string 110 may comprise at least one electrical conductor 113 in electrical communication with at least one component of the surface equipment 140. The downhole portion 114 of the tool string 110 may also comprise at least one electrical conductor 115 in electrical communication with at least one component of the surface equipment 140, wherein the electrical conductor 113 and the electrical conductor 115 may be in electrical communication via at least one electrical conductor 117 of the impact tool 116. Thus, the electrical conductors 113, 115, 117 may connect with and/or form a portion of the conveyance means 120, and may include various electrical connectors and/or interfaces along such path, including as described below. Although the conductors 113, 115, 117 are described as electrical conductors, the conductors 113, 115, 117 may also or instead be or comprise optical conductors.

Each of the electrical conductors 113, 115, 117 may comprise a plurality of individual conductors, such as may facilitate electrical communication of the uphole portion 112 of the tool string 110, the impact tool 116, and the downhole portion 114 of the tool string 110 with at least one component of the surface equipment 140, such as the power and control system 150. For example, the conveyance means 120 and the electrical conductors 113, 115, 117 may transmit and/or receive electrical power, data, and/or control signals between the power and control system 150 and one or more of the uphole portion 112, the impact tool 116, and the downhole portion 114. The electrical conductors 113, 115, 117 may further facilitate electrical communication between two or more of the uphole portion 112, the impact tool 116, and the downhole portion 114. Each of the uphole portion 112, the downhole portion 114, the impact tool 116, and/or portions thereof may comprise one or more electrical connectors, such as may electrically connect the electrical conductors 113, 115, 117.

The uphole and downhole portions 112, 114 of the tool string 110 may each be or comprise at least a portion of one or more downhole tools, modules, and/or other apparatus operable in wireline, while-drilling, coiled tubing, completion, production, and/or other operations. For example, the uphole and downhole portions 112, 114 may each be or comprise at least a portion of an acoustic tool, a centralizer, a cutting tool, a density tool, a directional tool, an electromagnetic (EM) tool, a formation evaluation, logging, and/or measurement tool, a gravity tool, a magnetic resonance tool, a mechanical interface tool, a monitoring tool, a neutron tool, a nuclear tool, an orientation tool, a perforating tool, a photoelectric factor tool, a plug, a plug setting tool, a porosity tool, a release tool, a reservoir characterization tool, a resistivity tool, a sampling tool, a seismic tool, a standoff, a surveying tool, and/or combinations thereof, among other examples also within the scope of the present disclosure. One or both of the uphole and downhole portions 112, 114 may comprise inclination sensors and/or other position sensors, such as one or more accelerometers, gyroscopic sensors (e.g., micro-electro-mechanical system (MEMS) gyros), magnetometers, and/or other sensors for utilization in determining the orientation of the tool string 110 (or a portion thereof) relative to the wellbore 102.

One or both of the uphole and downhole portions 112, 114 may comprise a correlation tool, such as a casing collar locator (CCL) for detecting ends of casing collars by sensing a magnetic irregularity caused by the relatively high mass of an end of a collar of the casing 108. The uphole and downhole portions 112, 114 may also or instead be or comprise a gamma ray (GR) tool that may be utilized for depth correlation. The CCL and/or GR tools may transmit signals in real-time to the wellsite surface equipment 140, such as the power and control system 150, via the conveyance means 120. The CCL and/or GR signals may be utilized to determine the position of the tool string 110 or portions thereof, such as with respect to known casing collar numbers and/or positions within the wellbore 102. Therefore, the CCL and/or GR tools may be utilized to detect and/or log the location of the tool string 110 within the wellbore 102, such as during intervention operations.

Although FIG. 1 depicts the tool string 110 comprising a single impact tool 116 directly coupled between two tool string portions 112, 114, the tool string 110 may include two, three, four, or more impact tools 116, which may be coupled together or separated from each other along the tool string 110 by the tool string portions 112, 114. The tool string 110 may also comprise additional tool string portions 112, 114 directly and/or indirectly coupled with the impact tool(s) 116. The impact tool 116 may be coupled elsewhere along the tool string 110 (relative to the location depicted in FIG. 1), whether in an uphole or downhole direction with respect to the uphole and downhole portions 112, 114 of the tool string 110.

Figure 2:
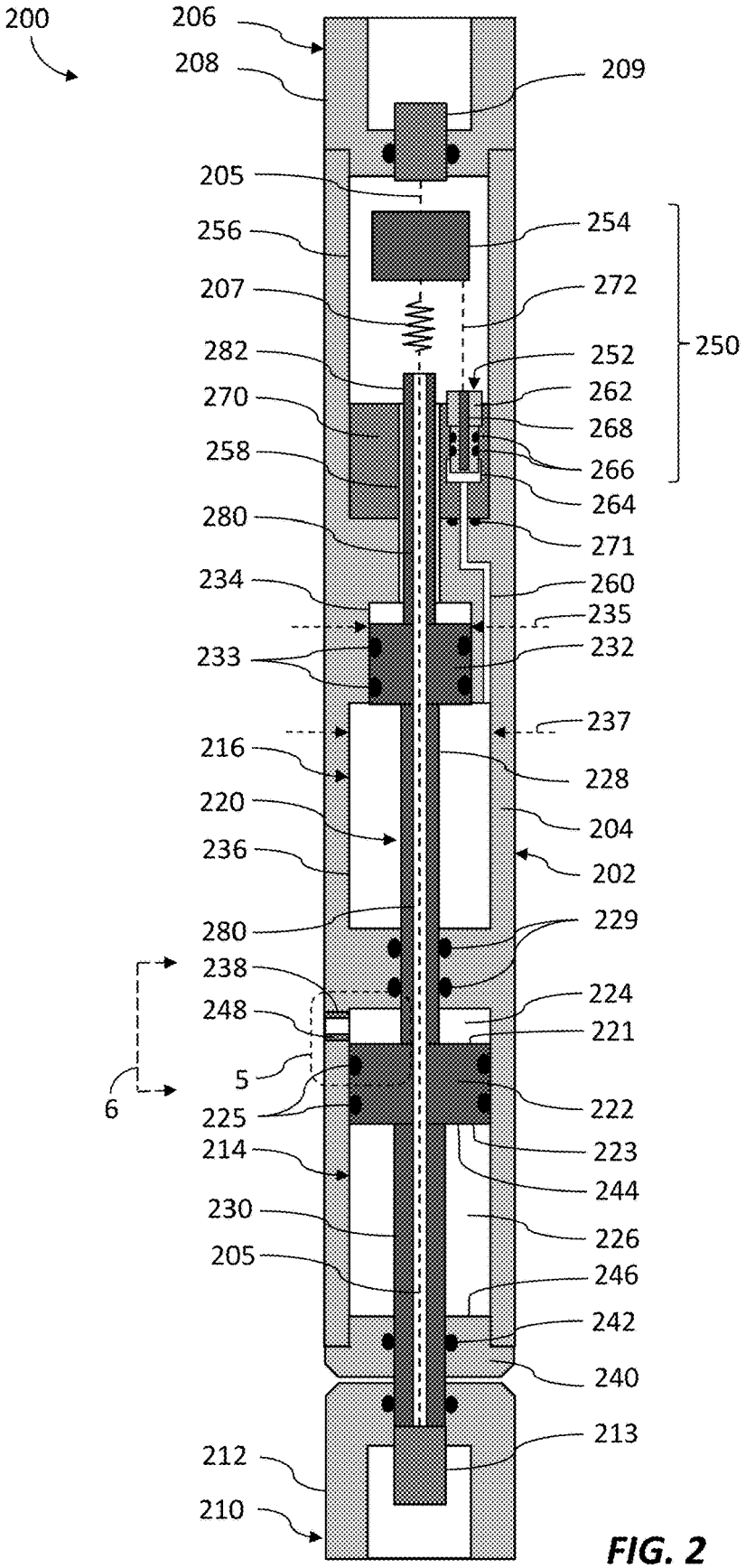
FIG. 2 is a schematic view of at least a portion of an example implementation of apparatus according to one or more aspects of the present disclosure.
Figure 3:
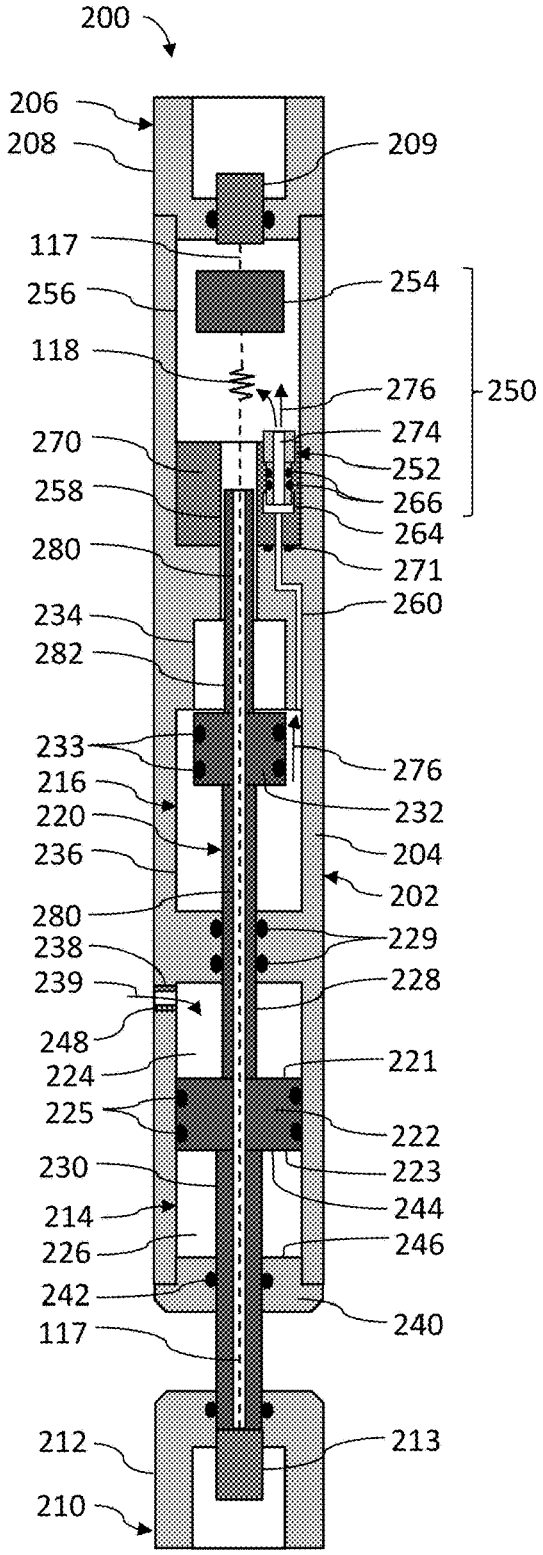
FIG. 3 is a schematic view of the apparatus shown in FIG. 2 at a different stage of operation.
Figure 4:
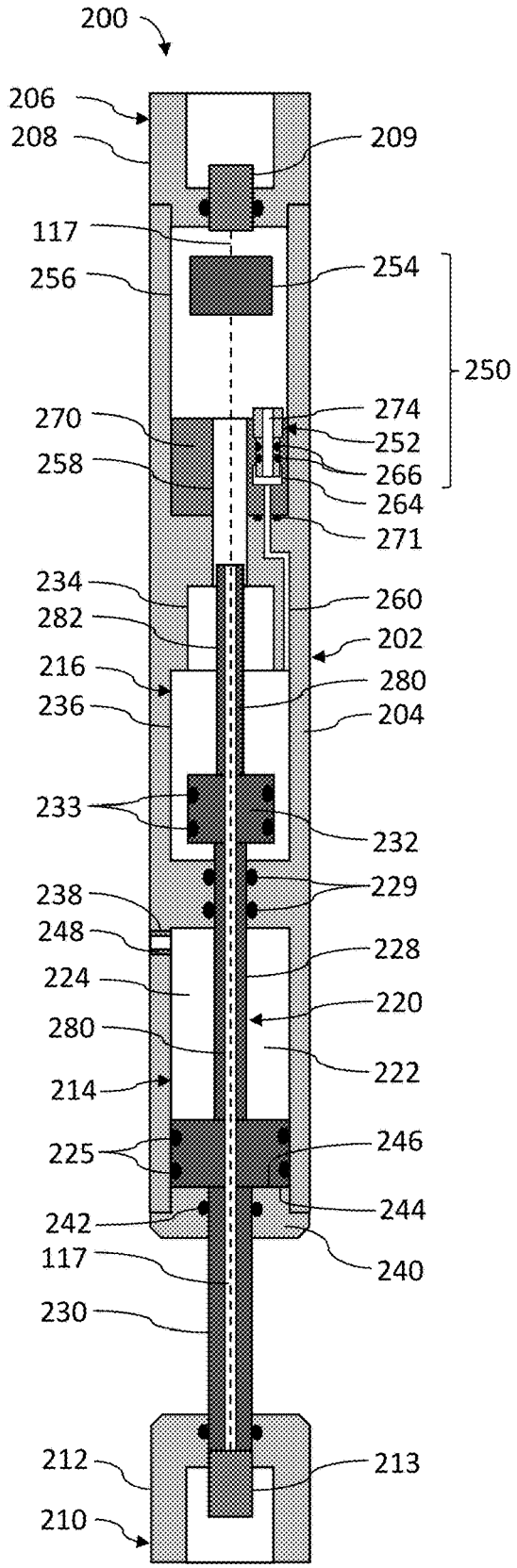
FIG. 4 is a schematic view of the apparatus shown in FIGS. 2 and 3 at a different stage of operation.

FIGS. 2-4 are schematic views of at least a portion of an example implementation of the impact tool 116 shown in FIG. 1 according to one or more aspects of the present disclosure, designated in FIGS. 2-4 by reference numeral 200. FIGS. 2-4 show the impact tool 200 at different stages of impact operations. The following description refers to FIGS. 1-4, collectively.

The impact tool 200 comprises a housing 202 defining or otherwise encompassing a plurality of internal spaces or volumes containing various components of the impact tool 200. Although the housing 202 is depicted in FIGS. 2-4 as a single unitary member, the housing 202 may be or comprise a plurality of housing sections coupled together to form the housing 202.

An uphole end 206 of the impact tool 200 may include a mechanical interface, a sub, and/or other interface means 208 for mechanically coupling the impact tool 200 with a corresponding interface means (not shown) of the uphole portion 112 of the tool string 110. The interface means 208 may be integrally formed with or coupled to the housing 202, such as via a threaded connection. A downhole end 210 of the impact tool 200 may include a mechanical interface, a sub, and/or other interface means 212 for mechanically coupling with a corresponding interface means (not shown) of the downhole portion 114 of the tool string 110. The interface means 212 may be integrally formed with or coupled to the impact tool 200, such as via a threaded connection. The interface means 208, 212 may be or comprise threaded connectors, fasteners, box couplings, pin couplings, and/or other mechanical coupling means. Although the interface means 208, 212 are depicted in FIGS. 2-4 as being a box connector, one or both of the interface means 208, 212 may be implemented as pin connector.

The uphole interface means 208 and/or other portion of the uphole end 206 of the impact tool 200 may further include an electrical interface 209 comprising means for electrically coupling an electrical conductor 205 extending along the impact tool 200 with a corresponding electrical interface (not shown) of the uphole portion 112 of the tool string 110, whereby the corresponding electrical interface of the uphole portion 112 may be in electrical connection with the electrical conductor 113. The downhole interface means 212 and/or other portion of the downhole end 210 of the impact tool 200 may include an electrical interface 213 comprising means for electrically coupling with a corresponding interface (not shown) of the downhole portion 114 of the tool string 110, whereby the corresponding electrical interface of the downhole tool string portion 114 may be in electrical connection with the electrical conductor 115. The electrical interfaces 209, 213 may each comprise electrical connectors, plugs, pins, receptacles, terminals, conduit boxes, and/or other electrical coupling means.

The impact tool 200 may comprise chambers 214, 216 within the housing 202 and a tandem piston and shaft assembly 220 (hereinafter referred to as a "piston assembly") slidably or otherwise movingly disposed within the housing 202. The piston assembly 220 may comprise a piston 222 slidably disposed within the chamber 214 and dividing the chamber 214 into opposing chamber volumes 224, 226. The piston 222 may sealingly engage an inner surface of the chamber 214 to fluidly separate the chamber volumes 224, 226. The piston 222 may carry fluid seals 225 that may fluidly seal against the inner surface of the chamber 214 to prevent fluids located on either side of the piston 222 from leaking between the chamber volumes 224, 226. The chamber 216 may include chamber portions 234, 236 having different inner diameters 235, 237, wherein the inner diameter 235 of the chamber portion 234 may be substantially smaller than the inner diameter 237 of the chamber portion 236.

The piston assembly 220 may further comprise a piston 232 movably disposed within the chamber 216. When the piston 232 is positioned within the chamber portion 234, the piston 242 may sealingly engage an inner surface of the chamber portion 234 to fluidly separate the chamber portions 234, 236. The piston 232 may carry fluid seals 233 that may fluidly seal against the inner surface of the chamber portion 234 to prevent fluids located on either side of the piston 242 from leaking between the chamber portions 234, 236. However, when the piston 232 moves out of the chamber portion 234 into the chamber portion 236, the fluid seals 233 or other portions of the piston 232 may not engage and seal against an inner surface of the chamber portion 236, thus permitting fluid within the chamber portion 236 to move around or past the piston 232.

A rod or shaft 228 may extend between the pistons 222, 232 through a bore or pathway extending through the housing 202 between the chambers 214, 216. The shaft 228 may connect the pistons 222, 232 such that the pistons 222, 232 move in unison. Fluid seals 229 may be disposed between the housing 202 and the shaft 228 to prevent or reduce fluid communication between the chamber volume 224 of the chamber 214 and the chamber portion 236 of the chamber 216.

The piston assembly 220 may further comprise a rod or shaft 230 connected with the piston 222 opposite the shaft 228. The shaft 230 may be axially movable within the chamber 214 and into and out of the housing 202 at a downhole end of the housing 202. A stop section 240 of the housing 202 may retain the piston 222 within the chamber 214 and fluidly seal against the shaft 230 to isolate the chamber volume 226 from the space external to the housing 202. The stop section 240 may comprise a central opening to permit the shaft 230 to axially move into and out of the housing 202, and a fluid seal 242 to fluidly seal against the shaft 230 to prevent fluid located external to the housing 202 from leaking into the chamber volume 226. A downhole end of the shaft 230 may be fixedly coupled with the downhole mechanical interface 212. Accordingly, the piston assembly 220 connects the housing 202 and the uphole mechanical interface 208 with the downhole mechanical interface 212.

The chamber volume 224 may be open to space external to the housing 202, and the chamber volume 226 may be fluidly isolated from the space external to the housing 202 by the piston 222. Thus, the piston 222 and shaft 230 may collectively function as a sealing member or device operable to fluidly isolate the chamber volume 226 from pressure and wellbore fluid in the space external to (i.e., surrounding) the impact tool 200. A face area 221 of the piston 222 may be exposed to the pressure within the space external to the housing 202, and an opposing face area 223 may be exposed to pressure within the chamber volume 226. The chamber volume 224 may be open to or in fluid communication with the space external to the housing 202 via one or more ports 238 or other openings extending through a wall 204 of the housing 202 at or near an uphole end of the chamber 214. Accordingly, when the impact tool 200 is conveyed downhole, the one or more ports 238 may permit wellbore fluid located within the wellbore 102 to be in communication with the chamber volume 224, such that the pressure within the chamber volume 224 is substantially equal to the hydrostatic pressure within the wellbore 102 external to the housing 202.

However, while the impact tool 200 is being conveyed downhole, the piston assembly 220 and, thus, the piston 222 may be maintained in a substantially fixed position such that the pressure within the chamber volume 226 is maintained substantially constant or otherwise substantially lower (e.g., at atmospheric pressure) than the hydrostatic wellbore pressure external to the housing 202. Accordingly, a pressure differential across the piston 222 may be formed as the impact tool 200 is conveyed downhole, imparting a downhole force to the piston 222 and an uphole force to the housing 202 to urge relative movement (i.e., expansion) between the piston assembly 220 and the housing 202. The downhole and uphole forces formed by the pressure differential across the piston 222 may be collectively referred to hereinafter as an "expansion force." Although the present disclosure may describe the piston assembly 220 as the moving component of the impact tool 200, it is done so for clarity and ease of understanding. It is to be understood that the expansion force may cause the housing 202 to move with respect to the piston assembly 220, for example, when the uphole tool string portion 112 coupled with the housing 202 via the interface means 208 is free and the downhole tool string portion 114 coupled with the interface means 212 is stuck within the wellbore 102.

The impact tool 200 may further comprise an impact feature 244 operable to impact or collide with a corresponding impact feature 246 to bring the relative motion between the piston assembly 220 and the housing 202 to a sudden stop to generate the impact. The impact feature 244 may be implemented as an outwardly extending radial surface, shoulder, boss, flange, and/or another impact member integral to or otherwise carried by the piston assembly 220, and the corresponding impact feature 246 may be implemented as an inwardly extending radial shoulder, boss, flange, and/or another impact member integral to or otherwise carried by the housing 202. For example, the impact feature 244 may be integral to or carried by a downhole portion or end of the piston 222, and the impact feature 246 may be integral to or carried by an uphole portion of the stop section 240 of the housing 202. However, the impact features 244, 246 may be integral to or carried by other portions of the impact tool 200. For example, the impact feature 244 may be integral to or carried by the shaft 230, and the impact feature 246 may be integral to or carried by other portions of the housing 202 defining the chamber 214. The impact feature 244 may also be integral to or carried by the shaft 228 or piston 232, and the impact feature 246 may be integral to or carried by a portion of the housing 202 defining the chamber portion 236.

The piston assembly 220 and the housing 202 may be selectively locked or held in a substantially constant relative position resisting the expansion force generated by the pressure differential across the piston 222. For example, hydraulic or another substantially incompressible fluid (e.g., distilled water) may be introduced and fluidly sealed within the chamber portion 236 of the chamber 216 prior to the impact tool 200 being conveyed downhole. Such fluid may be operable to prevent the piston 232 from moving out of the chamber portion 234 and into the chamber portion 236. Although the piston 232 may drift slightly into the chamber portion 236 during downhole conveyance, the piston assembly 220 may be maintained in a substantially constant position with respect to the housing 202 while the pressure within the chamber volume 224 increases as the impact tool 200 is conveyed downhole. A piston assembly release mechanism 250 (i.e., a triggering mechanism) may be provided within the housing 202 or another portion of the impact tool 200 to selectively release the piston 232 to permit the expansion force to move the piston assembly 220 and the housing 202 relative to each other. The operation of the piston assembly 220 and the release mechanism 250 is described in additional detail below.

FIG. 2 depicts the impact tool 200 in a contracted or untriggered position, in which the impact tool 200 has a minimum overall length measured between the uphole and downhole ends 206, 210. In such position, which is referred to hereinafter as a first impact tool position, the piston 222 may be located at the uphole end of the chamber 214, the piston 232 may be fully disposed within the chamber portion 234, and the shaft 230 may be retracted into the housing 202. The release mechanism 250 may be operable to maintain the piston assembly 220 and the housing 202 in the first position until the release mechanism 250 is operated or triggered to permit relative motion between the piston assembly 220 and housing 202 and, thus, permit the impact features 244, 246 to collide.

An example release mechanism 250 may include a fluid control device 252 and a switch 254 operable to electrically operate the fluid control device 252. One or more portions of the release mechanism 250 may be disposed within a chamber 256 within the housing 202. The chamber 256 may be fluidly connected with the chamber portion 234 of the chamber 216 via a fluid pathway 258. As the chamber 256 and the chamber portion 234 are fluidly connected by the fluid pathway 258, the chamber 256, the chamber portion 234, and the fluid pathway 258 may be collectively considered a single continuous space or chamber. The chamber 256 may be fluidly connected with the chamber portion 236 of the chamber 216 via a fluid pathway 260. The fluid control device 252 may be installed along or otherwise in association with the fluid pathway 260, and may be operable to block fluid flow through the fluid pathway 260 to fluidly isolate the chamber 256 and chamber portion 234 from the chamber portion 236. The fluid control device 252 may be or comprise a fluid blocking device, such as a plug 262, disposed within a cavity 264 at an end of the fluid pathway 260. The plug 262 may be fixedly maintained within the cavity 264, such as via corresponding threads. Fluid seals 266 may be disposed between the plug 262 and inner surface of the cavity 264 to prevent fluid leakage around or past the plug 262. The bolt 262 may contain therein an explosive charge 268 operable to breach, pierce, or open the bolt 262 or otherwise form a fluid pathway through, around, or past the bolt 262 to permit fluid flow from the chamber portion 236 into the chamber 256 and the chamber portion 234. The switch 254 may be electrically connected with the fluid control device 252 via a conductor 272, and may be operable to detonate the explosive charge 268 and, thus, trigger the impact tool 200.

However, instead of comprising the plug 262 having the explosive charge 268 therein, the fluid control device 252 may be or comprise a hydraulic valve operable to selectively permit fluid flow therethrough. Such valve may be sealingly disposed within the cavity 264 or otherwise along the fluid pathway 260 between the chamber 256 and the chamber portion 234. The hydraulic valve may comprise a fluid blocking member, such as a needle, a ball, a spool, or a plunger operable to move between closed flow and open flow positions. The hydraulic valve may be or comprise a cartridge valve, a spool valve, a globe valve, or another valve operable at high pressures associated with downhole operations to shift between closed and open flow positions to selectively permit fluid flow therethrough. The hydraulic valve may be actuated by an electrical actuator (not shown), such as a solenoid or an electrical motor, a hydraulic actuator, such as a hydraulic cylinder or motor, and/or by other means. The valve actuator may be electrically connected to the switch 254 via the electrical conductor 272, such as may permit the hydraulic valve to be actuated via the switch 254.

The switch 254 may be an addressable switch connected with or along the electrical conductor 205, such as may permit the switch 254 to be operated from the wellsite surface 104 by the power and control system 150 via the electrical conductors 113, 205 and other conductors extending between the power and control system 150 and the switch 254. If multiple impact tools 200 are included within the tool string 110 for creating multiple impacts, multiple addressable switches 254 may permit each of the impact tools 200 to be triggered sequentially or independently. The switch 254 may also be or comprise a timer, such as may activate or trigger the release mechanism 250 at a predetermined time. The switch 254 may be battery powered to permit the release mechanism 250 to be triggered without utilizing the electrical conductors 113, 205 extending to the wellsite surface 104. Although the switch 254 is shown and described above as being configured for wired communication, it is to be understood that the switch 254 may be configured for wireless communication with a corresponding wireless device located at the wellsite surface 104 or another portion of the tool string 110. Such wireless switch may permit the release mechanism 250 to be triggered from the wellsite surface 104 without utilizing the electrical conductors 113, 205 extending to the wellsite surface 104.

The cavity 264 and perhaps a portion of the fluid pathway 260 may be located within or extend through a support member or block 270. The support block 270 may be separate and distinct from the housing 202 and may be disposed within the chamber 256. The support block 270 may be a sacrificial member operable to absorb energy of the detonation of the explosive charge 268. The support block 270 may be replaced, such as if damaged by the detonation of the explosive charge 268, without having to replace one or more portions of the housing 202. One or more fluid seals 271 may be disposed between inner surface of the chamber 256 and the support block 270 around the fluid pathway 260 to prevent or reduce fluid communication between the fluid pathway 260 and the chamber 256.

The impact tool 200 may further comprise a continuous bore or pathway 280 extending longitudinally through various components of the impact tool 200, such as the chamber 256, the housing 202, the pistons 222, 232, and the shafts 228, 230. At least a portion of the electrical conductor 205 extending between electrical interfaces 209, 213 may extend through the pathway 280. One or more portions of the electrical conductor 205 may be coiled 207 within the pathway 280 and/or the chamber 256, such as may permit the electrical conductor 205 to expand in length as the length of the impact tool 200 expands during the impact operations. A portion of the pathway 280 may be defined by a tubular member 282 (i.e., a shaft comprising an axial bore) connected with the piston 232 opposite the shaft 228 and extending through the fluid pathway 258. The tubular member 282 may protect the electrical conductor 205 from the pressure wave and/or high velocity particles caused by the detonation of the explosive charge 268. The tubular member 282 may also maintain the electrical conductor 205 within the pathway 280 while the housing 202 and the piston assembly 220 move with respect to each other during and/or after the impact operations. For example, the tubular member 282 may prevent the electrical conductor 205 from coiling up within the chamber portion 234 when the piston assembly 220 is retracted after the impact operations.

Prior to being conveyed into the wellbore 102, the impact tool 200 may be configured to the first position such that the chamber volume 226 is formed and isolated from the space external to the housing 202. The pressure within the chamber volume 226 may be equalized with the atmospheric pressure at the wellsite surface 104.

However, if additional impact force is intended to be delivered by the impact tool 200, air may be drawn or evacuated from the chamber volume 226 to reduce the pressure within the chamber volume 226, resulting in a larger pressure differential across the piston 222 and, thus, an increase in the amount of stored energy when the impact tool 200 is conveyed downhole. Similarly, if a smaller impact force is intended to be delivered by the impact tool 200, air may be pumped into the chamber volume 226 to increase the pressure within the chamber volume 226, resulting in a smaller pressure differential across the piston 222 and, thus, a decrease in the amount of stored energy when the impact tool 200 is conveyed downhole. Prior to being conveyed into the wellbore 102, the chamber portion 236 may also be filled with the hydraulic fluid or another substantially incompressible fluid. The uphole end 206 of the impact tool 200 may then be connected with the uphole portion 112 of the tool string 110, and the downhole end 210 may be connected with the downhole portion 114 of the tool string 110. After the impact tool 200 is configured and coupled to the tool string 110, the tool string 110 may be conveyed into the wellbore 102 to a predetermined depth or position to perform the intended wellbore operations.

While the tool string 110 is conveyed downhole, the hydrostatic pressure in the wellbore 102 external to the housing 202 of the impact tool 200 increases. However, because the chamber volume 226 remains substantially unchanged and is fluidly isolated from the wellbore fluid within the chamber volume 224, the pressure within the chamber volume 226 remains substantially constant or otherwise substantially lower than the ambient wellbore pressure throughout the downhole conveyance of the tool sting 110. Similarly to the chamber volume 226, the chamber 256 and the chamber portion 234 may also be fluidly isolated from the chamber 214 and the wellbore 102 to maintain a substantially constant or otherwise substantially lower pressure within the chamber 256 and the chamber portion 234 while the tool string 110 is conveyed downhole. Accordingly, when the tool string 110 reaches the predetermined depth or position within the wellbore 102, the pressure within the chamber volume 224 may be substantially greater than the pressures within the chamber volume 226, the chamber 256, and the chamber portion 234. As described above, the pressure differential formed across the piston 222 results in the expansion force urging opposing movement (i.e., expansion) between the piston assembly 220 and the housing 202. Relative position between the piston assembly 220 and the housing 202 may be maintained substantially constant by the hydraulic fluid within the chamber portion 236, which prevents movement of the piston 232 into the chamber portion 236. Because the hydraulic fluid is fluidly sealed within the chamber portion 236, the pressure of the hydraulic fluid increases, thereby resisting movement of the piston 232 into the chamber portion 236 and, thus, resisting movement between the piston assembly 220 and the housing 202.

The net expansion force urging relative movement between the piston assembly 220 and the housing 202 may be substantially determined based on the pressure differential across the piston assembly 220. The expansion force (i.e., the force urging expansion of the shaft 230 and the housing 202) may be determined by multiplying the pressure within the chamber volume 224 by the uphole face area 221 of the piston 222, and by multiplying the pressure within the chamber 256 and chamber portion 234 by a cross-sectional area (not numbered) of the shaft 228. The contraction force (i.e., the force urging contraction of the shaft 230 and the housing 202) may be determined by multiplying the pressure within the chamber volume 226 by the downhole face area 223 of the piston 222, and by multiplying the pressure within the wellbore 102 by a cross-sectional area (not numbered) of the shaft 230. Calculating the difference between the expansion and contraction forces may substantially determine the net expansion force urging expansion (e.g., downhole movement of the piston assembly 220 with respect to the housing 202, uphole movement of the housing 202 with respect to the piston assembly 220) of the piston assembly 220 and the housing 202.

If the tool string 110 becomes stuck in the wellbore 102, such that it is intended to deliver an impact to the tool string 110, the impact tool 200 may be triggered, such as by operating the release mechanism 250, to impart the impact to the tool string 110 and in attempt to dislodge the tool string 110. The impact tool 200 may progress though a sequence of operational stages or positions to release the energy stored in the impact tool 200 and impart the impact to the tool string 110. FIGS. 3 and 4 are schematic views of the impact tool 200 shown in FIG. 2 in subsequent stages of impact operations according to one or more aspects of the present disclosure.

FIG. 3 depicts the impact tool 200 shortly after the release mechanism 250 was triggered to detonate the explosive charge 268 to form a fluid pathway 274 through or around the bolt 262 and, thus, trigger the impact operation. After the fluid pathway 274 is formed, the pressurized hydraulic fluid within the chamber portion 236 is permitted to flow through the fluid pathway 260 and the cavity 264 into the chamber 256 and the chamber portion 234, as indicated by arrows 276. Evacuation of the hydraulic fluid out of the chamber portion 236 permits the piston 232 to enter the chamber portion 236 and, thus, permits relative motion between the housing 202 and the piston assembly 220. If the stuck portion of the tool string 110 is the uphole portion 112 of the tool string 110 or another portion located uphole from the impact tool 200, then the piston assembly 220 and the downhole portion 114 of the tool string 110 will move in the downhole direction with respect to the housing 202 and the stuck uphole portion 112 of the tool string 110. However, if the stuck portion of the tool string 110 is the downhole portion 114 or another portion of the tool string 110 located downhole from the impact tool 200, then the housing 202 and the uphole portion 112 of the tool string 110 will move in the uphole direction with respect to the piston assembly 220 and the stuck downhole portion 114 of the tool string 110.

The piston assembly 220 and the housing 202 will continue to move with respect to each other until the piston 232 exits the chamber portion 234, at which point the chamber portions 234, 236 are no longer fluidly isolated. In such position, the hydraulic fluid within the chamber portion 236 is free to flow around the piston 232, permitting unobstructed movement of the piston 232 within the chamber portion 236 and, thus, permitting free relative movement between the piston assembly 220 and the housing 202. The expansion force generated by the wellbore fluid pressure within the chamber volume 224 may then increase relative velocity between the piston assembly 220 and the housing 202. The position of the impact tool 200 shown in FIG. 3 is referred to hereinafter as a second impact tool position.

The wellbore fluid may continue to flow into the chamber 214 via the port 238, as indicated by arrow 239, increasing the chamber volume 224 while decreasing the chamber volume 226. The piston assembly 220 and the housing 202 may continue to move with respect to each other until the impact features 244, 246 impact or collide together to suddenly decelerate the moving portions of the impact tool 200 and the tool string 110, imparting the impact to the stuck portion of the tool string 110. FIG. 4 shows the impact tool 200 in an impact position, referred to hereinafter as a third impact tool position, in which the impact features 244, 246 come into contact.

The impact tool 200 may be adjustable to control the magnitude of the impact generated by the impact tool 200. Wellbores may have different pressures, and the same wellbore may have different pressures at different depths. The energy available for creating the impact is proportional or otherwise directly related to the wellbore pressure in the space around the impact tool 200, and the impact tool 200 may comprise means for varying the speed of the relative motion between the housing 202 and piston assembly 220 in order to impart the intended impact force. Accordingly, a flow restrictor 248 may be disposed within the port 238 to reduce or otherwise control the rate of fluid flow from the space external to the housing 202 into the chamber portion 224 through the port 238. Although FIGS. 2-4 show a single port 238 extending through the housing wall 204, the housing 202 may comprise a plurality of ports 238 or other openings distributed circumferentially around the housing 202 at or near the uphole end of the chamber 214 to fluidly connect the space external to the housing 202 with the chamber volume 224. Each or some of the plurality of ports 238 may have a corresponding flow restrictor 248 disposed therein.

Figure 5:
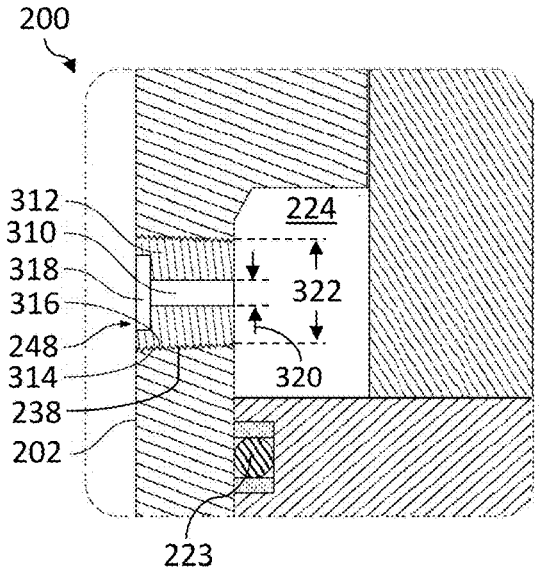
FIG. 5 is an enlarged view of a portion of the apparatus shown in FIG. 2.
Figure 6:
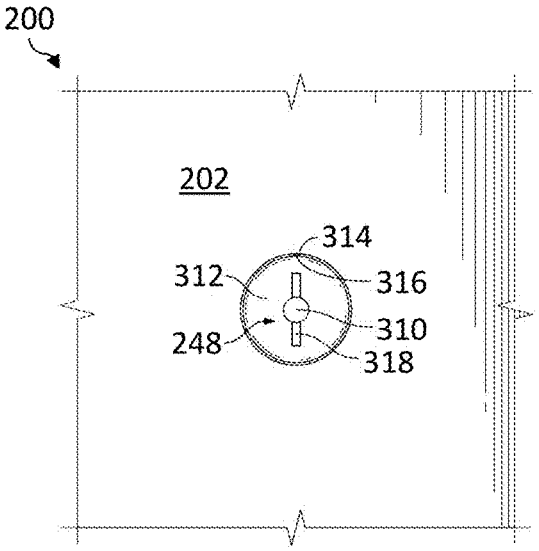
FIG. 6 is an enlarged view of another portion of the apparatus shown in FIG. 2.

FIGS. 5 and 6 are enlarged and side views, respectively, of a portion of the impact tool 200 shown in FIG. 2, depicting an example implementation of the flow restrictor 248 disposed within the port 238 according to one or more aspects of the present disclosure. For example, the flow restrictor 248 may comprise a needle valve, a metering valve, a ball valve, or a flow limiter, such as may contain one or more orifices 310 extending therethrough. The flow restrictor 248 may comprise a body 312 having a substantially cylindrical configuration and external threads 314, such as may threadedly engage with corresponding internal threads 316 of the housing port 238. The flow restrictor 248 may also comprise a slot 318 or a shaped cavity partially extending into the body 312, such as may be operable in conjunction with a hand-tool, wrench, and/or other tool to rotate and threadedly engage the flow restrictor 248 within the port 238. The orifice 310 may have a diameter 320 or cross-sectional area that is substantially smaller than a diameter 322 or cross-sectional area of the port 238.

The orifice 310 may have a predetermined cross-sectional area or an adjustable cross-sectional area. For example, the flow restrictor 248 may comprise an adjustable plunger or a needle (not shown) extending along or into the orifice 310, wherein the needle or the plunger may progressively open and close the cross-sectional area of the orifice 310. The flow restrictor 248 may comprise a single orifice 310 or multiple orifices (not shown), which may permit an increased flow rate through the flow restrictor 248. The orifice 310 may also comprise a different cross-sectional shape, such as a circle, an oval, a rectangle, or another shape. The flow restrictor 248 may by fixedly disposed within or about the port 238 by means other than threaded engagement. For example, the flow restrictor 248 may comprise or be utilized in conjunction with a flange or plate (not shown), such as may permit the flow restrictor 248 to be bolted to the housing 202 about the port 238. The flow restrictor 248 may also comprise or be utilized in conjunction with a filter or a permeable material (not shown) disposed within or about the orifice 310, such as may filter or otherwise prevent contaminants from flowing into the chamber volume 224.

Before or after being coupled to the tool string 110, the impact tool 200 may be configured to generate and/or impart a predetermined impact force to the tool string 110 based on, for example, depth of the tool string 110 within the wellbore 102, weight of the tool string 110, and wellbore fluid properties, such as viscosity. The magnitude of the intended impact may also depend on the structural strength or resiliency of the tool string 110 to withstand the impact force. Knowing such operational parameters may permit a surface operator to predict the velocity of the piston assembly 220 and, thus, adjust the one or more flow restrictors 248 to adjust the velocity of the piston assembly 220. For example, the impact tool 200 may be configured by selecting and installing one or more flow restrictors 248, such as may cause the impact tool 200 to generate and deliver the predetermined impact force. Flow rate through an opening is proportional to a diameter and/or cross-sectional area of such opening, such that the rate at which the wellbore fluid flows into the chamber volume 224 may be controlled by selecting an appropriate orifice diameter 320 of the flow restrictor 248. The wellbore fluid is substantially incompressible, such that reducing the rate of flow of the wellbore fluid into the impact tool 200 may reduce the rate of speed at which the piston assembly 220 and the housing 202 move with respect to each other, which in turn, may reduce the magnitude of the impact to the tool string 110.

The magnitude of the impact force may be configured, for example, by selecting and installing flow restrictors 248 having orifice sizes based on the operational parameters described above. Flow restrictors 248 having predetermined orifice diameters 320 and/or cross-sectional areas may be utilized interchangeably to control the magnitude of the impact. For example, the diameter 320 of the orifice 310 of one or more of the flow restrictors 248 may be about 1/16 inch (in) (about 1.6 millimeters (mm)), about 1/8 in (about 3.2 mm), about 1/4 in (about 6.4 mm), or about 3/8 in (about 9.5 mm), and the cross-sectional area of the orifice 310 may be about 0.003 $in^2$ (about 1.98 $mm^2$), about 0.012 $in^2$ (about 7.92 $mm^2$), about 0.049 $in^2$ (about 31.7 $mm^2$), or about 0.110 $in^2$ (about 71.2 $mm^2$). However, other dimensions are also within the scope of the present disclosure.

Instead of or in addition to utilizing the flow restrictors 248, the flow rate at which the wellbore fluid enters the chamber volume 224 may be controlled by closing some of the ports 238 to prevent flow through the closed ports 238 in order to control a cumulative flow area (i.e., open area) of the ports 238. For example, one or more of the ports 238 may be blocked or closed off by one or more plugs (not shown) threadedly engaged or otherwise disposed within one or more of the ports 238. Furthermore, if multiple impact tools 200 are included within the tool string 110 for creating multiple impacts, the magnitude of the impact force imparted by each impact tool 200 may be controlled or adjusted independently. For example, the flow restrictors 248 or plugs may be utilized to set an increasing impact force schedule, wherein each subsequent impact force imparted by each subsequent impact tool 200 increases until the tool string 110 is set free.

In addition to utilizing one or more flow restrictors 248 or plugs, the magnitude of the impact may also be controlled by adjusting the cumulative uphole and downhole areas of the piston assembly 220. For example, the net expansion force generated by the impact tool 200 may be controlled by adjusting the diameters of the pistons 222, 232 and/or the diameters of the shafts 228, 230. The magnitude of the impact may also be controlled by adjusting travel distance (i.e., the stroke distance) of the piston assembly 220 to adjust the distance over which the piston 220 assembly accelerates.

Figure 7:
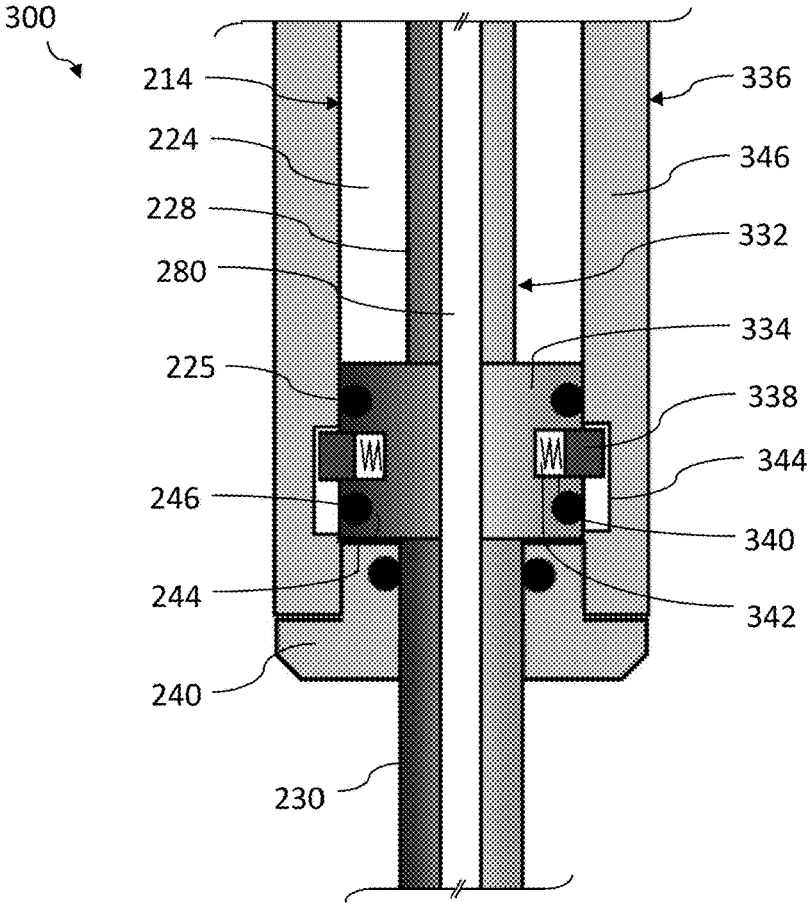
FIG. 7 is a schematic view of a portion of an example implementation of apparatus according to one or more aspects of the present disclosure.

FIG. 7 is an enlarged view of a portion of an example implementation of an impact tool 300 according to one or more aspects of the present disclosure. The impact tool 300 is depicted in the third impact tool position, and may comprise one or more similar features of the impact tool 200, including where indicated by like reference numbers, except as described below. The following description refers to FIGS. 1, 4, and 7, collectively.

The impact tool 300 may comprise a piston assembly 332 comprising a piston 334 slidably disposed within the chamber 214. The piston 334 may comprise fluid seals 225 sealingly engaging inner surface of the chamber 214. The impact tool 300 may further comprise means for locking or otherwise maintaining the piston assembly 332 and a housing 336 of the impact tool 300 in a locked or otherwise constant relative position, such as the third impact tool position. The locking means may include one or more latches 338 disposed within corresponding cavities 340 or other spaces extending radially into the piston 334. Each latch 338 may be radially movable within the corresponding cavity 340 and biased in a radially outward direction by a corresponding biasing member 342 disposed within the cavity 340 and against the latch 338. The biasing members 342 may comprise coil springs, leaf springs, gas springs, wave springs, spring washers, torsion springs, and/or other biasing means.

During impact operations of the impact tool 300, while the piston 334 and the housing 336 move with respect to each other, the latches 338 may be maintained at least partially retracted within the cavities 340 by an inner surface of the housing defining the chamber 214. When the impact features 244, 246 approach each other, the latches 338 may extend radially outwards into corresponding cavities 344 or other spaces extending radially into a wall 346 of the housing 336 at or near a downhole end of the chamber 214. After the latches 308 are inserted within the corresponding cavities 344, the piston 334 and the housing 336 may be locked in a relative position, such as may prevent the shaft 230 from retracting or collapsing into the housing 336 if the impact tool 300 is axially compressed during subsequent impact or other downhole operations. For example, if additional impact tools 300 are included within the tool string 110 for creating additional impacts, locking the piston assembly 332 and housing 336 may permit a subsequent impact force to be transmitted through the locked impact tool 300 to a stuck portion of the tool string 110. However, if the piston assembly 332 and the housing 236 of the triggered impact tool 300 are permitted to move relative to each other, the triggered impact tool 300 may absorb at least a portion of the subsequent impact force (e.g., similarly to a spring or shock absorber) and/or not transfer all of the impact force to the stuck portion of the tool string 110.

The impact tools 200, 300 described herein and shown in FIGS. 2-4 and 7 are oriented such that the shaft 230 extends from the housing 202 in the downhole direction. However, the orientation of the impact tools 200, 300 within the tool string 110 may be reversed, such that the impact tool end 210 is coupled with the uphole portion 112 of the tool string 110 and the impact tool end 206 is coupled with the downhole portion 114 of the tool string 110, without affecting the operation of the impact tools 200, 300.

In view of the entirety of the present disclosure, including the figures and the claims, a person having ordinary skill in the art will readily recognize that the present disclosure introduces an apparatus comprising an impact tool operable to be coupled between portions of a tool string conveyable within a wellbore extending into a subterranean formation, and to impart an impact force to the tool string, wherein the impact tool comprises: (A) a first chamber within a housing; (B) a second chamber within the housing; and (C) a piston shaft assembly axially movable with respect to the housing and comprising: (1) a first piston slidably disposed within the first chamber and dividing the first chamber into a first chamber portion and a second chamber portion, wherein the first chamber portion is open to a space external to the housing; (2) a first shaft connected with the first piston and axially movable into and out of the housing; (3) a second piston slidably disposed within the second chamber; and (4) a second shaft connecting the first and second pistons, wherein the second chamber contains a fluid operable to maintain the piston shaft assembly and the housing in a predetermined relative position.

The impact tool may comprise a fluid control device operable to permit flow of the fluid into and out of the second chamber to permit relative movement between the piston shaft assembly and the housing. The fluid control device may be operable to: block flow of the fluid contained within the second chamber to maintain the piston shaft assembly and the housing in the predetermined relative position; and selectively permit flow of the fluid into and out of the second chamber to permit the relative movement between the piston shaft assembly and the housing. The second piston may divide the second chamber into a third chamber portion and a fourth chamber portion, the third chamber portion may contain the fluid, and the fluid control device may be operable to permit the fluid to flow out of the third chamber portion to permit the relative movement between the piston shaft assembly and the housing. The fluid control device may be operable to permit the fluid to flow out of the third chamber portion into the fourth chamber portion to permit the relative movement between the piston shaft assembly and the housing. The impact tool may comprise a third chamber, and the fluid control device may be operable to permit flow of the fluid out of the third chamber portion into the third chamber to permit the relative movement between the piston shaft assembly and the housing. The third chamber may be fluidly connected with the fourth chamber portion, and the fluid control device may be operable to permit the fluid to flow out of the third chamber portion into the third chamber and the fourth chamber portion to permit the relative movement between the piston shaft assembly and the housing.

The fluid control device may comprise a plug containing an explosive charge operable to form a fluid pathway through or around the plug when detonated. The impact tool may comprise a detonator switch remotely operable to detonate the explosive charge from a wellsite surface from which the wellbore extends.

The fluid control device may comprise a fluid valve.

The fluid control device may be remotely operable from a wellsite surface from which the wellbore extends.

When the impact tool is conveyed within the wellbore, a first pressure within the first chamber portion may be substantially equal to hydrostatic wellbore pressure within the space external to the housing, a second pressure within the second chamber portion may be maintained substantially lower than the first pressure within the first chamber portion, a pressure differential between the first and second pressures may urge relative movement between the piston shaft assembly and the housing, and the relative movement between the piston shaft assembly and the housing may terminate with an impact between the piston shaft assembly and the housing. The impact tool may comprise a fluid control device operable to: block flow of the fluid into and out of the second chamber to maintain the piston shaft assembly and housing in the predetermined relative position; and selectively permit flow of the fluid into or out of the second chamber and thus permit the pressure differential to cause the relative movement between the piston shaft assembly and the housing. The second pressure may be maintained substantially equal to atmospheric pressure at a wellsite surface from which the wellbore extends.

The first chamber portion may be open to the space external to the housing via at least one opening extending through the housing.

The fluid may be a hydraulic fluid.

The piston shaft assembly may comprise a bore extending longitudinally therethrough, and the impact tool may comprise an electrical path comprising one or more conductors and extending through the bore between opposing connection interfaces of the impact tool. The piston shaft assembly may comprise a tubular member connected with the second piston opposite the second shaft.

The present disclosure also introduces a method comprising coupling an impact tool between portions of a tool string, wherein the impact tool comprises: (A) a first chamber within a housing; (B) a second chamber within the housing; and (C) a piston shaft assembly axially movable with respect to the housing and comprising: (1) a first piston dividing the first chamber into a first chamber portion and a second chamber portion, wherein the first chamber portion is open to a space external to the housing; (2) a first shaft connected with the first piston and axially movable into and out of the housing; (3) a second piston dividing the second chamber into a third chamber portion and a fourth chamber portion, wherein the third chamber portion contains a fluid; and (4) a second shaft connecting the first and second pistons.

The first chamber portion may be open to the space external to the housing via at least one opening extending through the housing.

The piston shaft assembly may comprise a bore extending longitudinally therethrough, the impact tool may comprise an electrical conductor extending through the bore, and the method may comprise transmitting electrical signals from a wellsite surface from which the wellbore extends through the electrical conductor.

The method may comprise conveying the tool string within a wellbore while: a first pressure within the first chamber portion is substantially equal to hydrostatic wellbore pressure within the space external to the housing; maintaining within the second chamber portion a second pressure that is substantially lower than the first pressure to form a pressure differential across the first piston that urges relative movement between the piston shaft assembly and the housing; and the fluid within the third chamber portion maintains the piston shaft assembly and the housing in a predetermined relative position.

The method may comprise operating a fluid control device to permit the fluid to flow out of the third chamber portion to permit the relative movement between the piston shaft assembly and the housing and thus permit the shaft assembly and the housing to impact each other. While conveying the tool string within the wellbore, the fluid control device may block flow of the fluid out of the third chamber portion to maintain the piston shaft assembly and the housing in a predetermined relative position.

Operating the fluid control device may permit the fluid to flow out of the third chamber portion into the fourth chamber portion to permit the relative movement between the piston shaft assembly and the housing.

The impact tool may comprise a third chamber fluidly connected with the fourth chamber portion, and operating the fluid control device may permit the fluid to flow out of the third chamber portion into the third chamber and the fourth chamber portion to permit the relative movement between the piston shaft assembly and the housing.

The method may comprise, prior to conveying the tool string within the wellbore and operating the fluid control device, introducing the fluid into the third chamber portion.

The fluid control device may comprise a fluid plug containing an explosive charge, and operating the fluid control device may comprise detonating the explosive charge to form a fluid pathway through or around the fluid plug. The impact tool may comprise a detonator switch, and operating the fluid control device may comprise remotely operating the detonator switch from a wellsite surface from which the wellbore extends to detonate the explosive charge.

The fluid control device may comprise a fluid valve, and operating the fluid control device may comprise remotely operating the fluid valve from a wellsite surface from which the wellbore extends to an open flow position.

While conveying the tool string within the wellbore, the second pressure may be maintained substantially equal to atmospheric pressure at a wellsite surface from which the wellbore extends.

The foregoing outlines features of several implementations so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the implementations introduced herein. A person having ordinary skill in the art should also realize that such equivalent constructions do not depart from the scope of the present disclosure, and that they may make various changes, substitutions and alterations herein without departing from the spirit and scope of the present disclosure.

The Abstract at the end of this disclosure is provided to allow the reader to quickly ascertain the nature of the technical disclosure. It is submitted with the understanding that it will not be used to interpret or limit the scope or meaning of the claims.

What is claimed is:

1. An apparatus comprising:

an impact tool operable to be coupled between portions of a tool string conveyable within a wellbore extending into a subterranean formation, and to impart an impact force to the tool string, wherein the impact tool comprises:

a first chamber within a housing;

a second chamber within the housing;

a piston shaft assembly axially movable with respect to the housing and comprising:

a first piston slidably disposed within the first chamber and dividing the first chamber into a first chamber portion and a second chamber portion, wherein the first chamber portion is open to a space external to the housing;

a first shaft connected with the first piston and axially movable into and out of the housing;

a second piston slidably disposed within the second chamber; and a second shaft connecting the first and second pistons, wherein the second chamber contains a fluid operable to maintain the piston shaft assembly and the housing in a predetermined relative position; and a fluid control device operable to permit flow of the fluid into and out of the second chamber to permit relative movement between the piston shaft assembly and the housing, wherein the fluid control device is operable to:

block flow of the fluid contained within the second chamber to maintain the piston shaft assembly and the housing in the predetermined relative position; and selectively permit flow of the fluid into and out of the second chamber to permit the relative movement between the piston shaft assembly and the housing.

2. The apparatus of claim 1 wherein the first chamber portion is open to the space external to the housing via at least one opening extending through the housing.

3. The apparatus of claim 1 wherein the fluid is a hydraulic fluid.

4. An apparatus comprising:

an impact tool operable to be coupled between portions of a tool string conveyable within a wellbore extending into a subterranean formation, and to impart an impact force to the tool string, wherein the impact tool comprises:

a first chamber within a housing;

a second chamber within the housing;

a piston shaft assembly axially movable with respect to the housing and comprising:

a first piston slidably disposed within the first chamber and dividing the first chamber into a first chamber portion and a second chamber portion, wherein the first chamber portion is open to a space external to the housing;

a first shaft connected with the first piston and axially movable into and out of the housing;

a second piston slidably disposed within the second chamber; and a second shaft connecting the first and second pistons, wherein the second chamber contains a fluid operable to maintain the piston shaft assembly and the housing in a predetermined relative position; and a fluid control device operable to permit flow of the fluid into and out of the second chamber to permit relative movement between the piston shaft assembly and the housing;

wherein the second piston divides the second chamber into a third chamber portion and a fourth chamber portion, wherein the third chamber portion contains the fluid, and wherein the fluid control device is operable to permit the fluid to flow out of the third chamber portion to permit the relative movement between the piston shaft assembly and the housing; and wherein the fluid control device is operable to permit the fluid to flow out of the third chamber portion into the fourth chamber portion to permit the relative movement between the piston shaft assembly and the housing.

5. An apparatus comprising:

an impact tool operable to be coupled between portions of a tool string conveyable within a wellbore extending into a subterranean formation, and to impart an impact force to the tool string, wherein the impact tool comprises:

a first chamber within a housing;

a second chamber within the housing;

a piston shaft assembly axially movable with respect to the housing and comprising:

a first piston slidably disposed within the first chamber and dividing the first chamber into a first chamber portion and a second chamber portion, wherein the first chamber portion is open to a space external to the housing;

a first shaft connected with the first piston and axially movable into and out of the housing;

a second piston slidably disposed within the second chamber; and a second shaft connecting the first and second pistons, wherein the second chamber contains a fluid operable to maintain the piston shaft assembly and the housing in a predetermined relative position; and a fluid control device operable to permit flow of the fluid into and out of the second chamber to permit relative movement between the piston shaft assembly and the housing;

wherein the second piston divides the second chamber into a third chamber portion and a fourth chamber portion, wherein the third chamber portion contains the fluid, and wherein the fluid control device is operable to permit the fluid to flow out of the third chamber portion to permit the relative movement between the piston shaft assembly and the housing; and wherein the impact tool further comprises a third chamber, and wherein the fluid control device is operable to permit flow of the fluid out of the third chamber portion into the third chamber to permit the relative movement between the piston shaft assembly and the housing.

6. The apparatus of claim 5 wherein the third chamber is fluidly connected with the fourth chamber portion, and wherein the fluid control device is operable to permit the fluid to flow out of the third chamber portion into the third chamber and the fourth chamber portion to permit the relative movement between the piston shaft assembly and the housing.

7. An apparatus comprising:

an impact tool operable to be coupled between portions of a tool string conveyable within a wellbore extending into a subterranean formation, and to impart an impact force to the tool string, wherein the impact tool comprises:

a first chamber within a housing;

a second chamber within the housing;

a piston shaft assembly axially movable with respect to the housing and comprising:

a first piston slidably disposed within the first chamber and dividing the first chamber into a first chamber portion and a second chamber portion, wherein the first chamber portion is open to a space external to the housing;

a first shaft connected with the first piston and axially movable into and out of the housing;

a second piston slidably disposed within the second chamber; and a second shaft connecting the first and second pistons, wherein the second chamber contains a fluid operable to maintain the piston shaft assembly and the housing in a predetermined relative position; and a fluid control device operable to permit flow of the fluid into and out of the second chamber to permit relative movement between the piston shaft assembly and the housing;

wherein the fluid control device comprises a plug containing an explosive charge operable to form a fluid pathway through or around the plug when detonated.

8. The apparatus of claim 7 wherein the impact tool further comprises a detonator switch remotely operable to detonate the explosive charge from a wellsite surface from which the wellbore extends.

9. An apparatus comprising:

an impact tool operable to be coupled between portions of a tool string conveyable within a wellbore extending into a subterranean formation, and to impart an impact force to the tool string, wherein the impact tool comprises:

a first chamber within a housing;

a second chamber within the housing;

a piston shaft assembly axially movable with respect to the housing and comprising:

a first piston slidably disposed within the first chamber and dividing the first chamber into a first chamber portion and a second chamber portion, wherein the first chamber portion is open to a space external to the housing;

a first shaft connected with the first piston and axially movable into and out of the housing;

a second piston slidably disposed within the second chamber; and a second shaft connecting the first and second pistons, wherein the second chamber contains a fluid operable to maintain the piston shaft assembly and the housing in a predetermined relative position; and a fluid control device operable to permit flow of the fluid into and out of the second chamber to permit relative movement between the piston shaft assembly and the housing;

wherein the fluid control device comprises a fluid valve.

10. An apparatus comprising:

an impact tool operable to be coupled between portions of a tool string conveyable within a wellbore extending into a subterranean formation, and to impart an impact force to the tool string, wherein the impact tool comprises:

a first chamber within a housing;

a second chamber within the housing;

a piston shaft assembly axially movable with respect to the housing and comprising:

a first piston slidably disposed within the first chamber and dividing the first chamber into a first chamber portion and a second chamber portion, wherein the first chamber portion is open to a space external to the housing;

a first shaft connected with the first piston and axially movable into and out of the housing;

a second piston slidably disposed within the second chamber; and a second shaft connecting the first and second pistons, wherein the second chamber contains a fluid operable to maintain the piston shaft assembly and the housing in a predetermined relative position; and a fluid control device operable to permit flow of the fluid into and out of the second chamber to permit relative movement between the piston shaft assembly and the housing;

wherein the fluid control device is remotely operable from a wellsite surface from which the wellbore extends.

11. An apparatus comprising:

an impact tool operable to be coupled between portions of a tool string conveyable within a wellbore extending into a subterranean formation, and to impart an impact force to the tool string, wherein the impact tool comprises:

a first chamber within a housing;

a second chamber within the housing; and a piston shaft assembly axially movable with respect to the housing and comprising:

a first piston slidably disposed within the first chamber and dividing the first chamber into a first chamber portion and a second chamber portion, wherein the first chamber portion is open to a space external to the housing;

a first shaft connected with the first piston and axially movable into and out of the housing;

a second piston slidably disposed within the second chamber; and a second shaft connecting the first and second pistons, wherein the second chamber contains a fluid operable to maintain the piston shaft assembly and the housing in a predetermined relative position;

wherein, when the impact tool is conveyed within the wellbore:

a first pressure within the first chamber portion is substantially equal to hydrostatic wellbore pressure within the space external to the housing;

a second pressure within the second chamber portion is maintained substantially lower than the first pressure within the first chamber portion;

a pressure differential between the first and second pressures urges relative movement between the piston shaft assembly and the housing; and the relative movement between the piston shaft assembly and the housing terminates with an impact between the piston shaft assembly and the housing.

12. The apparatus of claim 11 wherein the impact tool further comprises a fluid control device operable to:

block flow of the fluid into and out of the second chamber to maintain the piston shaft assembly and housing in the predetermined relative position; and selectively permit flow of the fluid into or out of the second chamber and thus permit the pressure differential to cause the relative movement between the piston shaft assembly and the housing.

13. The apparatus of claim 11 wherein the second pressure is maintained substantially equal to atmospheric pressure at a wellsite surface from which the wellbore extends.

14. An apparatus comprising:

an impact tool operable to be coupled between portions of a tool string conveyable within a wellbore extending into a subterranean formation, and to impart an impact force to the tool string, wherein the impact tool comprises:

a first chamber within a housing;

a second chamber within the housing; and a piston shaft assembly axially movable with respect to the housing and comprising:

a first piston slidably disposed within the first chamber and dividing the first chamber into a first chamber portion and a second chamber portion, wherein the first chamber portion is open to a space external to the housing;

a first shaft connected with the first piston and axially movable into and out of the housing;

a second piston slidably disposed within the second chamber; and a second shaft connecting the first and second pistons, wherein the second chamber contains a fluid operable to maintain the piston shaft assembly and the housing in a predetermined relative position;

wherein the piston shaft assembly comprises a bore extending longitudinally therethrough, and wherein the impact tool further comprises an electrical path comprising one or more conductors and extending through the bore between opposing connection interfaces of the impact tool.

15. A method comprising:

coupling an impact tool between portions of a tool string, wherein the impact tool comprises:

a first chamber within a housing;

a second chamber within the housing; and a piston shaft assembly axially movable with respect to the housing and comprising:

a first piston dividing the first chamber into a first chamber portion and a second chamber portion, wherein the first chamber portion is open to a space external to the housing;

a first shaft connected with the first piston and axially movable into and out of the housing;

a second piston dividing the second chamber into a third chamber portion and a fourth chamber portion, wherein the third chamber portion contains a fluid; and a second shaft connecting the first and second pistons; and conveying the tool string within a wellbore while:

a first pressure within the first chamber portion is substantially equal to hydrostatic wellbore pressure within the space external to the housing;

maintaining within the second chamber portion a second pressure that is substantially lower than the first pressure to form a pressure differential across the first piston that urges relative movement between the piston shaft assembly and the housing; and the fluid within the third chamber portion maintains the piston shaft assembly and the housing in a predetermined relative position.

16. The method of claim 15 further comprising operating a fluid control device to permit the fluid to flow out of the third chamber portion to permit the relative movement between the piston shaft assembly and the housing and thus permit the shaft assembly and the housing to impact each other.

* * * * *